United States Patent [19]

Kasuya et al.

[11] 4,406,602

[45] Sep. 27, 1983

[54] SCREW ROTOR WITH SPECIFIC TOOTH PROFILE

[75] Inventors: Katsuhiko Kasuya, Shimoinayoshi; Mitsuru Fujiwara, Dejimamura; Tetsuzo Matsunaga; Masaya Imai, both of Sakuramura; Yasuo Takahashi, Ayase, all of Japan

[73] Assignee: Hitachi, Ltd., Tokyo, Japan

[21] Appl. No.: 326,358

[22] Filed: Dec. 1, 1981

[30] Foreign Application Priority Data

Dec. 3, 1980 [JP] Japan ..... 55-169574

[51] Int. Cl.[3] ..... F04C 18/16

[52] U.S. Cl. ..... 418/201

[58] Field of Search ..... 74/466; 418/150, 197, 418/201, 202, 203

[56] References Cited

U.S. PATENT DOCUMENTS

| | | | |
|---|---|---|---|
| 2,622,787 | 12/1952 | Nilsson | 74/466 |
| 3,314,598 | 4/1967 | Lysholm | 418/201 |
| 3,787,154 | 1/1974 | Edstrom | 418/201 |
| 4,028,026 | 6/1977 | Menssen | 418/201 |
| 4,088,427 | 5/1978 | Emanuelsson | 418/201 |
| 4,140,445 | 2/1979 | Schibbye | 418/201 |

FOREIGN PATENT DOCUMENTS

| | | | |
|---|---|---|---|
| 53-145108 | 12/1978 | Japan | 418/201 |

*Primary Examiner*—John J. Vrablik
*Assistant Examiner*—Jane E. Obee
*Attorney, Agent, or Firm*—Antonelli, Terry & Wands

[57] ABSTRACT

In a screw rotor including a female rotor member and a male rotor member rotatable about parallel shafts and respectively while meshing with each other, the forward face flank of the female rotor member is composed of a first flank of the forward face formed by a parabolic curve, and a second flank of the forward face formed by a circular arc of a radius $R_2$, and the backward face flank of the female rotor member is composed of a first flank of the backward face generated by the backward face tooth top flank of the male rotor member having a radius $R_5$, and a second flank of the backward face formed by a circular arc of a radius $R_3$ which is smaller than the radius $R_2$ of the second flank of the forward face flank. The tooth profile of the male rotor member is essentially formed by the forward face flank and the backward face flank of the female rotor member.

7 Claims, 5 Drawing Figures

SCREW ROTOR WITH SPECIFIC TOOTH PROFILE

BACKGROUND OF THE INVENTION

This invention relates to screw rotors with a specific tooth profile suitable for use with screw compressors, and more particularly it is concerned with the shape and configuration of a screw rotor capable of performing hobbing.

Generally, a screw compressor comprises a male rotor member and a female rotor member forming a pair and maintained in meshing engagement with each other rotatably supported in a casing formed with an inlet port and an outlet port. This type of screw compressor generally uses a screw rotor of a tooth profile of nonsymmetrical type in which the forward face of the rotor and the backward face thereof differ from each other in shape and configuration.

Since this screw rotor of the nonsymmetrical type has a complex rotor profile, various problems have been raised with regard to improvement in the performance of the compressor and its production technology. With regard to the improvement of its operation performance, it is necessary that in addition to increasing the dimensional accuracy of the rotor members and casing, the length of the seal line constituted by the tooth profile and the area of the blow holes be taken into consideration.

In order to achieve these improvements, proposals have been made to use novel rotor profiles as shown in U.S. Pat. Nos. 4,140,445 and 3,787,154, for example. The rotor profiles shown in the prior art are primarily intended to provide improvements in operation performance by minimizing the blow holes, for example, in solving the problems with regard to operation performance. It is believed, however, that the problems with regard to operation performance and production technology have not thoroughly been studied and satisfactory solutions therefor have not been proposed. Let us set forth our views in greater detail in this respect. First, concerning operation performance, a problem would be raised with regard to the length of a seal line that would influence the operation performance of a screw compressor. The length of the seal line that is produced between the rotor members has particular bearing on the leak area between the rotor members, and when the seal line has a relatively large length, the leakage increases, thereby causing a reduction in the performance characteristics of the compressor. When the blow holes are large in area, the fluid would leak from the high pressure chamber side to the low pressure chamber side, thereby causing a reduction in the performance characteristics of the compressor. Additionally, the tooth profile is preferably such that the influences exerted by the degree of precision with which the tooth profile of the rotor members is finished on the operation performance of the compressor are minimized. Stated differently, the tooth profile is preferably such that the operation performance is not readily influenced by the degree of precision of the finishes given to the rotor members.

Concerning the production technology, it is desired that an improved process be developed which, as compared with a production process relying on a single cutter of the prior art, is capable of producing a screw rotor and which is superior to the prior art process in productivity and precision of finishes given to the screw rotor so that it is suitable for performing hobbing. Such process is further preferably capable of producing a screw rotor with a high degree of precision finishes at low cost, with the tools having high dimensional accuracy and a prolonged service life.

The problems stated hereinabove have been pointed out in the U.S. patents referred to hereinabove and proposals have been made to provide improvements for the purpose of obviating the problems. However, as it stands now, no satisfactory proposals have ever been made to provide a tooth profile which is capable of simultaneously meeting the requirements of solving the problems of how to improve operation performance and of improving production technology.

In this type of screw rotor of the nonsymmetrical type, when the rotor members mesh with each other or when the force of rotation is transmitted at a pressure angle $\alpha$ with the forward face flank of the male rotor member and the forward face flank of the female rotor member meshing with each other at a certain point, the force of rotation acts as a normal component of force of the tooth surface and a radial component of force of the rotor. It would be impossible to disregard the fact that these components of force manifest themselves as mechanical losses occurring between the tooth surfaces of the rotor members or in the bearings of the rotor.

SUMMARY OF THE INVENTION

An object of this invention is to provide a screw rotor whose operation performance is improved by minimizing the area of the blow holes and particularly reducing the seal line between the rotor members.

Another object is to provide a screw rotor provided with a tooth profile capable of increasing the degree of precision of the form of the cutting edge of a hob for generating the teeth of the rotor and prolonging the service life of the hob.

Still another object is to provide a screw rotor having a tooth profile capable of minimizing mechanical losses that might occur between the tooth surfaces of the rotor members and in the bearings of the rotor.

The aforesaid objects are accomplished according to the invention by providing, in a screw rotor suitable for use with a screw compressor including a female rotor member and a male rotor member rotatable about two parallel shafts respectively while meshing with each other, the improvement which resides in that the forward face flank of the female rotor member is composed of a first flank of the forward face formed by a parabola focused on the inside of a pitch circle of the female rotor member and a second flank of the forward face formed by a circular arc of a radius $R_2$ centered at the pitch circle, and the backward face flank of the female rotor member is composed of a first flank of the backward face generated by a circular arc on the side of the tooth top of the male rotor member which has a radius $R_5$ centered on the axis connecting the centers of rotor shaft together, and a second flank of the backward face formed by a circular arc of a radius $R_3$ centered within the pitch circle, wherein the male rotor member has its projections essentially formed by the generating action of the forward face flank of the female rotor member and the second flank of the backward face of the backward face flank thereof.

The construction as well as the features and advantages of the invention will become apparent from the description set forth hereinafter when considered in conjunctin with the accompanying drawings.

DETAILED DESCRIPTION OF THE PREFERRED EMBODIMENTS

Figure 1:
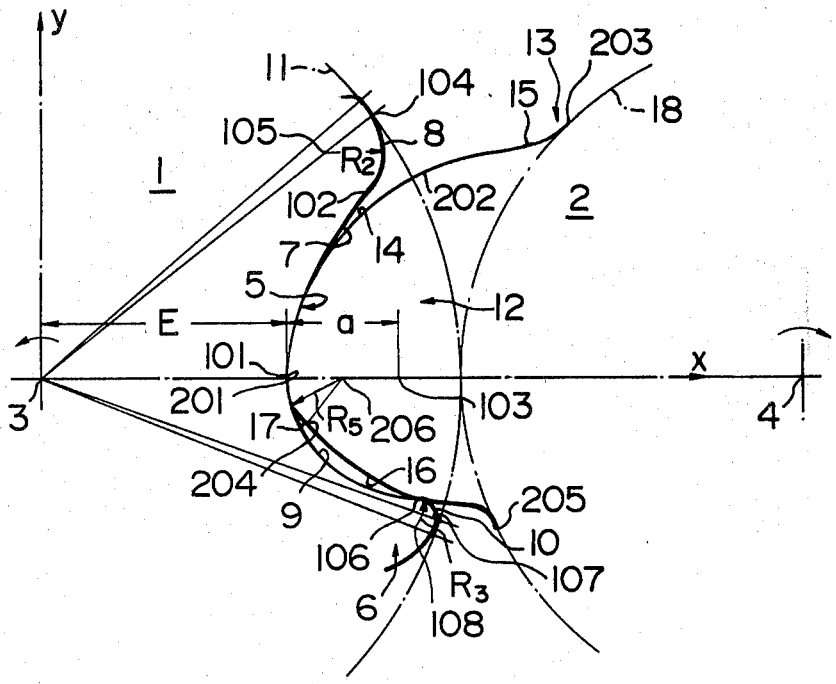
FIG. 1 is a sectional view of the screw rotor comprising one embodiment of the invention, taken at a right angle to the axis of the rotor.

FIG. 1 shows one embodiment of the screw rotor in conformity with the invention, in which a female rotor member 1 and a male rotor member 2 are shown as rotating in a plane perpendicular to the axis of rotation of the rotor.

The female rotor member 1 and the male rotor member 2 in meshing engagement with each other rotate in the respective directions indicated by arrows. By rotating about the center points 3 and 4, respectively, of rotary shafts within a casing, not shown, the rotor members 1 and 2 perform the function of a compressor.

The female rotor member 1 has formed therein a plurality of grooves 5 and projections 6. The grooves 5 are each composed of principal parts including a forward face first flank 7, a forward face second flank 8, a backward face first flank 9 and a backward face second flank 10. These principal parts are located inside a pitch circle 11.

The male rotor member 2 has formed therein a plurality of projections 12 and grooves 13. The projections 12 are each composed of principal parts including a forward face first flank 14, a forward face second flank 15, a backward face first flank 16 and a backward face second flank 17. These principal parts are located outside a pitch circle 18.

The shape and configuration of the grooves 5 of the female rotor member 1 will be described in some detail. The forward face first flank 7 of the female rotor member 1 is defined between points 101 and 102.

The portion of the grooves 5 between the points 101 and 102 of the forward face first flank 7 has a configuration which is formed by a parabolic curve expressed by $Y^2=4a(X-E)$ in a Cartesian coordinates system of X-Y axis in which the center point 3 of the rotary shaft serves as the origin, wherein E is the distance between the center point 3 of the rotary shaft and the point 101, and a is the distance between the point 101 and focal point 103 inside the pitch circle 11 on the line connecting the center points 3 and 4 of the two rotary shafts together. In this case, in view of the relationship between the pressure angle and the face width which is to be set, the female rotor 1 preferably has an outer diameter $D_F$ which is selected such that the ratio of the distance a in the aforesaid formula of parabola to the outer diameter $D_F$ is within the range $0.08 \leqq a/D_F \leqq 0.15$.

By forming the forward face first flank 7 by a parabola, it is possible to increase the curvature of this portion of the grooves 5 as compared with that of the corresponding portion of the rotor of the prior art. This enables an increase in the pressure angle of the hob cutter, thereby facilitating a hobbing operation. The result of this is that a hob equipped with a cutting edge profile of high precision finishes can be produced at low cost.

Also, the use of a parabolic curve for defining the forward face flank 7 reduces the rate of slips that occur in the portion of the grooves 5 between the points 101 and 102 of the forward face first flank 7 of the female rotor 1 when motive force is transmitted as the male rotor 2 drives the female rotor 1. This conducive to minimization of wear that would be caused on the two rotor members 1 and 2 and a reduction in mechanical losses that would occur in the bearings of the rotors, etc.

Figure 2:
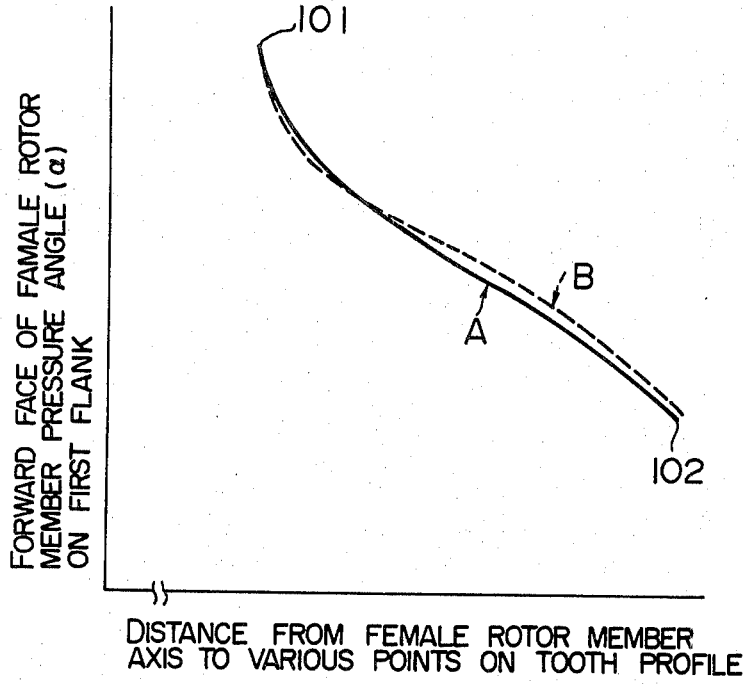
FIG. 2 is a view showing the parabolic curve describing the first flank of the forward face of the screw rotor according to the invention in comparison with a circular arcuate curve used for forming the forward face flank of a screw rotor of the prior art.

The reasons why the mechanical losses can be reduced will be described by referring to FIGS. 2 and 3. To compare the configuration of the forward face first flank 7 of the female rotor member 1 according to the invention with that of the forward face flank of a female rotor of the prior art, as an example, the configuration of the forward face flank of the female rotor of the prior art which is formed by the bottom flank of a forward face tooth defined by a radius centered at the point of intersection of the pitch circles of the two rotor members and a forward face first flank defined by a radius greater than the first-mentioned radius. FIG. 2 shows a comparison of the curvature between the starting point and the terminating point of the forward face flank of the female rotor member of the prior art with the curvature of the portion of the grooves 5 between the points 101 and 102 of the forward face first flank 7 of the female member 1 according to the invention, with respect to the pressure angle at several points on the tooth profile.

In FIG. 2, a solid line A represents changes in the pressure angle $\alpha$ of the forward face first flank 7 of the female rotor member 1 according to the invention, and a dotted line B indicates changes in the pressure angle $\alpha$ of the forward face flank of the female rotor member of the prior art. As can be clearly seen in FIG. 2, the pressure angle $\alpha$ in each position of the forward face first flank 7 decreases successively in going from point 101 toward point 102 as indicated by the solid line A and it becomes smaller than the pressure angle $\alpha$ of the female rotor member of the prior art in the vicinity of point 102 on the tooth top side as indicated by the broken line B. The process in which mechanical losses are reduced by the aforesaid decrease in pressure angle $\alpha$ will now be described by referring to FIG. 3.

Figure 3:
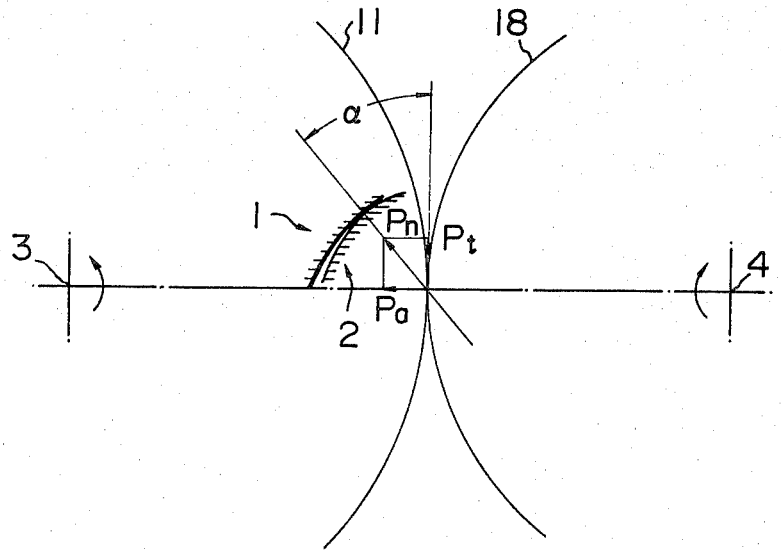
FIG. 3 is a view showing the pressure angle of the parabolic curve forming the first flank of the forward face in the screw rotor according to the invention in comparison with the pressure angle of a circular arcuate curve of the prior art.

FIG. 3 shows the forward face first flank 7 of the female rotor member 1 and the forward face first flank 14 of the male rotor member 2 which are in meshing engagement with each other at a certain point at the pressure angle $\alpha$ when the male rotor member 2 rotates in the direction of the arrow to drive the female rotor member 1. As shown, as a force of rotation $P_t$ is transmitted from the male rotor member 2 to the female rotor member 1, a normally-oriented force $P_n=P_t/\cos\alpha$ is exerted normally of the tooth surface, and a radially-oriented force $P_a=P_t\tan\alpha$ is exerted radially of the rotor. With the force of rotation $P_t$ being constant, the normally-oriented force $P_n$ and the radially-oriented force $P_a$ both show a reduction as the pressure angle $\alpha$ decreases. When these forces show a reductionin the vicinity of point 102 of the forward face first flank 7 which transmits the motive force as aforesaid, mechanical losses occurring between the tooth surfaces and in the bearings of the rotor show a reduction, to thereby greatly increase the efficiency of the compressor in operation.

Referring to FIG. 1 again, the forward face second flank 8 is composed of a portion of the grooves 5 between points 102 and 104 and defined by a circular arc of a radius $R_2$ centered at a point 105 inside the pitch circle 11. The circular arc of the radius $R_2$ is excessively larger than the circular arc of the radius $R_3$ defining the backward face second flank 10 of the female rotor member 1. By forming the forward face second flank 8 in this way, it is possible to greatly increase the service life of the cutting edge of the hob cutter for the male rotor member.

The backward face first flank 9 is composed of a portion of the groove between points 101 and 106 which is generated by the circular arc of a backward face tooth top flank 17 of the male rotor member 2. The backward face second flank 10 is composed of a portion of the groove 5 between points 106 and 107 which is defined by a circular arc of a radius $R_3$ centered at a point 108 inside the pitch circle 11. The radius $R_3$ is extremely smaller than the radius $R_2$, although it is in the range enabling the service life of the hob cutting tooth top to be sufficiently prolonged to be economical. Thus, the ratio of the radius $R_3$ to the radius $R_2$ is set within the range $0.15 \leqq R_3/R_2 \leqq 0.45$ to meet the two requirements of prolonging the service life of a hobbing tool and reducing the area of the blow holes without any trouble. Stated differently, the lower limit is set by taking into consideration the service life of the tool and the upper limit is decided by being taking into consideration the need to minimize the area of the blow holes.

By generating the backward face first flank 9 by the circular arc of the backward face tooth top flank 17 of the male rotor member 2, a point generated portion can be eliminated and the sealing effect can be blunted to the influences exerted by profile precision. By reducing the radius $R_3$ of the circular arc forming the backwad face second flank 10 than the radius $R_2$ of the circular arc forming the backward face second flank 10, it is possible to greatly reduce the area of the blow holes between the rotor and casing. This is conducive to a great increase in the operation performance of the compressor.

The male rotor member 2 will now be described. The forward face first flank 14 is composed of a portion of the projection 12 between points 201 and 202 and its profile is generated by a parabolic curve of the forward face first flank 8 between points 101 and 102 of the female rotor member 1. The portion between points 202 and 203 of the forward face second flank 15 and the portion between points 204 and 205 of the backward face first flank 16 of the male rotor member 2 have a profile generated by a circular arc of the portion between points 102 and 104 of the forward face second flank 8 and the portion between points 106 and 107 of the backward face second flank 10 respectively of the female rotor member 1. The profile of the portion between points 201 and 204 of the backward face tooth top flank 17 is formed by a circular arc of a radius $R_5$ centered at a point 206 on the line connecting together the center points 3 and 4 of the rotary shafts of the two rotors 1 and 2 respectively.

Figure 4:
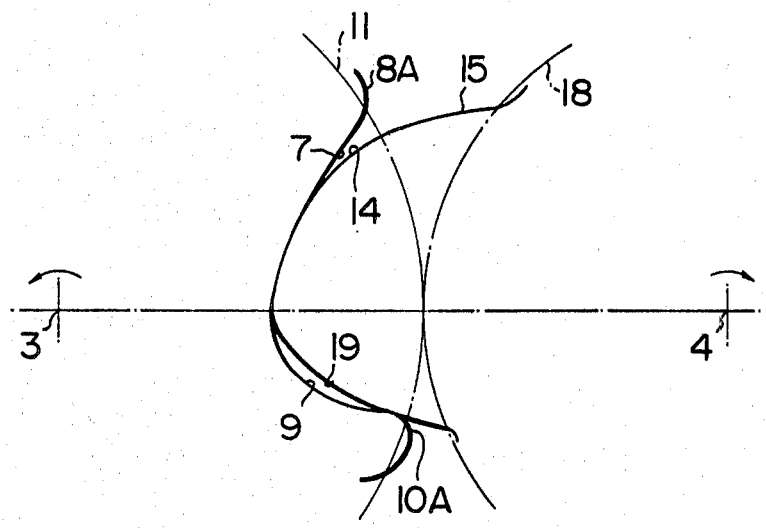
FIG. 4 is a sectional view of the screw rotor comprising another embodiment of the invention, taken at a right angle to the axis of the rotor.
Figure 5:
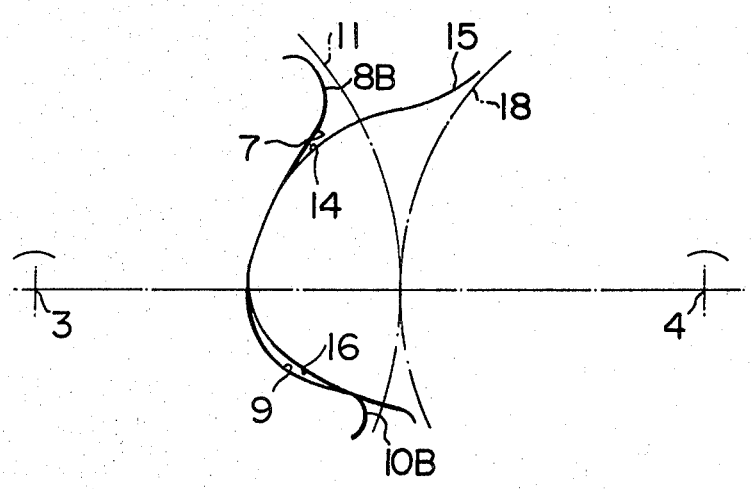
FIG. 5 is a sectional view of the screw rotor comprising still another embodiment, taken at a right angle to the axis of the rotor.

FIG. 4 and 5 show other embodiments of the invention which are distinct from the embodiment shown in FIG. 1 in that a part or the whole of the forward face second flank 8A, 8B and the backward face second flank 10A, 10B of the female rotor member 1 are located inside or outside the pitch circle 11.

By arranging the forward face second flank 8A, 8B and the backward face second flank 10A, 10B as described hereinabove, it is possible to select as desired the coefficient of tooth profile.

From the foregoing description, it will be appreciated that in the screw rotor according to the invention, the forward face first flank 7 and forward face second flank 8 constituting the forward face flank of the female rotor member 1 are formed by a parabola and a circular arc of a large radius $R_2$, respectively, and the backward face first flank 16 and the backward face second flank constituting the backward face flank of the male rotor member 2 are formed by a curve generated by a circular arc of the radius $R_5$ on the front side of the male rotor member 2 and a circular arc of the radius $R_3$ which is extremely smaller than the radius $R_2$ of the forward face second flank. By virtue of this feature, it is possible to greatly prolong the service life of the hobbing tool and reduce the area of the blow holes. This is conducive to a marked increase in the operation performance of the compressor and a reduction in mechanical losses which might occur between the tooth surfaces and in the bearings of the rotor.

What we claim is:

1. In a screw rotor suitable for use with a screw compressor including a female rotor member and a male rotor member rotatable about two parallel shafts respectively while meshing with each other, the improvement which resides in that a forward face flank of the female rotor member is composed of a first flank of a forward face formed by a parabola focused on an inside of a pitch circle of the female rotor member, and a second flank of the forward face formed by a circular arc of a radius $R_2$, centered at the pitch circle, and a backward face flank of the female rotor member is composed of a first flank of the backward face generated by a circular arc on a side of a tooth top of the male rotor member which has a radius $R_5$ and centered on an axis connecting the centers of rotor shaft together, and a second flank of the backward face formed by a circular arc of a radius $R_3$ centered within the pitch circle, wherein the male rotor member has projections essentially formed by a generating action of the forward face flank of the female rotor member and the second flank of the backward face of the backward face flank thereof.

2. A screw rotor as claimed in claim 1, wherein the radius $R_3$ of the circular arc forming the second flank of the backward face of the female rotor member is extremely smaller than the radius $R_2$ of the circular arc forming the second flank of the forward face thereof.

3. A screw rotor as claimed in claim 2, wherein the ratio of the radius $R_3$ of the circular arc forming the second flank of the backward face of the female rotor member to the radius $R_2$ of the circular arc forming the second flank of the forward face thereof is in the range $0.15 \leqq R_3/R_2 \leqq 0.45$.

4. A screw rotor as claimed in claim 1, wherein the first flank of the forward face of the female rotor member is formed in a manner for producing a drive force.

5. A screw rotor as claimed in claim 1, wherein the outermost peripheral portion of the female rotor member is located on the pitch circle.

6. A screw rotor as claimed in claim 1, wherein the outermost peripheral portion of the female rotor member is located outside the pitch circle.

7. A screw rotor as claimed in claim 1, wherein the outmost peripheral portion of the female rotor member is located inside the pitch circle of the female rotor member.

* * * * *